US005471283A

United States Patent [19]

Irihara et al.

[11] Patent Number: 5,471,283

[45] Date of Patent: Nov. 28, 1995

[54] DEVICE FOR PREVENTING BREAKDOWN OF CONTACT CHARGER FOR USE IN ELECTROPHOTOGRAPHIC PRINTING MACHINE

[75] Inventors: Kouichi Irihara, Nara; Hideo Yamasa, Ikoma; Fumio Shimazu, Yamatokoriyama; Takasumi Wada, Nara, all of Japan

[73] Assignee: Sharp Kabushiki Kaisha, Osaka, Japan

[21] Appl. No.: 227,693

[22] Filed: Apr. 14, 1994

Related U.S. Application Data

[63] Continuation of Ser. No. 989,808, Dec. 11, 1992, abandoned.

[30] Foreign Application Priority Data

Dec. 11, 1991 [JP] Japan ..... 3-327773

[51] Int. Cl.[6] ..... G03G 21/00

[52] U.S. Cl. ..... 355/205; 355/207; 355/211; 355/219; 355/271

[58] Field of Search ..... 355/210, 219, 355/200, 216, 205, 207, 206, 271, 277, 209; 361/220, 221, 225, 212, 222

[56] References Cited

U.S. PATENT DOCUMENTS

| | | | |
|---|---|---|---|
| 4,777,554 | 10/1988 | Gokita | 355/205 X |
| 4,890,125 | 12/1989 | Egawa et al. . | |
| 5,012,279 | 4/1991 | Nakajima et al. | 355/205 |
| 5,138,380 | 8/1992 | Umeda et al. | 355/219 X |
| 5,144,368 | 9/1992 | Ohzeki et al. | 355/219 |
| 5,313,359 | 5/1994 | Imagawa et al. | 355/219 X |

FOREIGN PATENT DOCUMENTS

| | | |
|---|---|---|
| 2618575 | 1/1989 | France . |
| 56-104349 | 8/1981 | Japan . |
| 64-91160 | 4/1989 | Japan . |
| 2-173678 | 7/1990 | Japan . |
| 3-048509 | 7/1991 | Japan . |

*Primary Examiner*—A. T. Grimley
*Assistant Examiner*—Shuk Y. Lee
*Attorney, Agent, or Firm*—David G. Conlin; Kevin J. Fournier

[57] ABSTRACT

An electrophotographic printing machine is provided with a photoreceptor drum including a photosensitive layer formed on a surface of an electrically conductive base, a contact charger in contact with the photosensitive layer for charging the photosensitive layer by applying thereto a DC voltage, and a voltage drop detecting circuit for outputting a detecting signal when the voltage has dropped below a reference voltage. When a defect exists such as a pin hole on the photosensitive layer, the voltage being applied to the photosensitive layer of the contact charger drops. In this state, a detecting signal is output to a controller from the voltage drop detecting circuit. When the controller receives the detecting signal, the controller signals to stop the operation of the entire device, and signals a display to display a message indicating to exchange the photoreceptor drum. According to the electrophotographic printing machine, the image forming process will not be continued with the detective portion on the photosensitive layer. Thus, the contact charger can be prevented from breaking down.

42 Claims, 9 Drawing Sheets

DEVICE FOR PREVENTING BREAKDOWN OF CONTACT CHARGER FOR USE IN ELECTROPHOTOGRAPHIC PRINTING MACHINE

This is a continuation of application Ser. No. 07/989,808 filed on Dec. 11, 1992, now abandoned.

FIELD OF THE INVENTION

The present invention relates to an electrophotographic printing machine provided with a charger which charges the surface of a photoreceptor by applying thereto a DC voltage through a contacting component in contact therewith.

BACKGROUND OF THE INVENTION

An electrophotographic printing machine forms images by an electrophotography as described below. First, a photosensitive layer formed on the surface of a photoreceptor is uniformly charged with a single polarity. Then, an electrostatic latent image is formed on the surface of the photoreceptor through the process of exposure. Further, toner is made to adhere to the electrostatic latent image, thereby forming images.

In the electrophotographic printing machine thus described, conventionally a corona discharger has been used as a charger for uniformly charging with a single polarity the photosensitive layer formed on the surface of the photoreceptor. However, in the case of adopting the corona discharger, an application of high voltage is required for a wire electrode when charging the photosensitive layer. This presents the problem since a power supply for applying voltage to the wire electrode becomes larger in size. Moreover, with the corona discharger, an erosion of the components of the machine and the deterioration of the surface of the photoreceptor are likely to occur due to ozone produced in the process of corona-discharging the photosensitive layer. This results in the problem by making unclear and fuzzy the images, or by adversely affecting the human body, etc.

In order to counteract the above-mentioned problems, a contact charger has been recently proposed for a charger which does not require a large power source nor produces ozone. Such contact charger is provided with an electrically conductive contacting component in contact with the photosensitive layer formed on the surface of the photoreceptor. With the contact charger, the photosensitive layer formed on the surface of the photoreceptor is charged through the contacting component by applying thereto DC voltage through the contacting component. With reference to FIG. 8, the following will describe the electrophotographic printing machine provided with the contact charger through the case of adopting a charge roller for a contacting component among those roller-shaped, blade-shaped, and brush-shaped.

A contact charger 100 is provided with a charge roller 101 and a power supply 102 for applying DC voltage to the charge roller 101. The charge roller 101 is arranged such that an electrically conductive elastic layer is formed on a surface of an electrically conductive cylindrical roller base 101*b*. The charge roller 101 is freely rotative around an axis parallel to a rotation axis of a photoreceptor 103. Further, the charge roller 101 is in contact with the surface of the photoreceptor 103 with a predetermined nip width. The charge roller 101 is rotated in the direction of D in conjunction with the rotation of the photoreceptor 103 in the direction of C in the figure.

The power supply 102 being connected to the roller base of the charge roller 101 applies DC voltage to the surface of the photoreceptor 103 through the charge roller 101.

Here, the photoreceptor 103 is designed so as to have the photosensitive layer 103*a* on the surface of a drum base 103*b* having a property as an insulator when it is not exposed, on the other hand, having an electric property which makes the exposed portion thereof electrically conductive when it is exposed. The drum base 103*b* is made of an electrically conductive material and connected to ground so that a charge on the exposed portion of the photosensitive layer 103*a* is released to ground.

With the above arrangement, the charge is moved onto the photosensitive layer 103*a* of the photoreceptor 103 through the charge roller 101 whereon DC voltage has been applied from the power supply 102, thereby uniformly charging the photosensitive layer 103*a*.

However, with the above contact charger 100, since the surface of the photoreceptor 103 is in contact with the charge roller 101, a chemical change due to an erosion, etc., is likely to occur on the surface of the photoreceptor 103 which may create a defect such as a pin hole on the photosensitive layer 103*a* of the photoreceptor 103. Moreover, when dusts or contaminants are inserted into the contacting portion between the surface of the photoreceptor 103 and the charge roller 101, a defect is likely to occur on the photosensitive layer 103*a* of the photoreceptor 103.

With the electrophotographic printing machine employing the contract charger 100, the following problems may arise when a defect exists such as a pin hole on the photosensitive layer 103*a* formed on the surface of the photoreceptor 103.

Namely, at the defective portion of the photosensitive layer 103*a*, electrically conductive drum base 103*b* is exposed. Therefore, there will be a continuity between the surface of the charge roller 101 and the drum base 103*b* when the charge roller 101 is in contact with the defective portion of the photosensitive layer 103*a*. This means that excessive current flows between the charge roller 101 and the base of the photoreceptor 103, and thus voltage of the charge roller 101 suddenly drops. As a result, an improper charge (drop in the charged potential) occurs in an axis direction at the defective portion on the photosensitive layer 103*a* formed on the surface of the photoreceptor 103, thereby presenting the problem of an irregular image.

Moreover, heat is generated by the excessive current flowing across the charge roller 101 and the drum base 103*b* of the photoreceptor 103. If this occurs, the photosensitive layer 103 is more quickly deteriorated. Further, if the image forming process is continued, the contact charger 100 may break down, and the electrophotographic printing machine cannot be used.

SUMMARY OF THE INVENTION

An object of the present invention is to provide an electrophotographic printing machine which permits to prevent beforehand a contact charger from breaking down when a defect exists on a surface of a photoreceptor.

In order to achieve the above object, the electrophotographic printing machine of the present invention is characterized in comprising: photoreceptor means including a photosensitive layer having a photoconductivity formed on a surface of an electrically conductive base being connected to ground; contact charger means in contact with the photosensitive layer for charging the photosensitive layer by applying thereto a voltage; charge voltage drop detection means for monitoring the voltage being applied to the photosensitive layer from the contact charger means and for outputting a detecting signal to control means when the voltage has dropped below a reference voltage; and control means for controlling an operation of the device, wherein the control means signals to stop the operation of the entire device based on a detecting signal input from the charge voltage drop detection means.

In the above arrangement, the contact charger means is in contact with the photosensitive layer formed on the surface of the photoreceptor means so as to apply a voltage to the photosensitive layer.

In the above arrangement, if no defect exists on the photosensitive layer on the photoreceptor means, voltage applied to the photosensitive layer from the contract charger means will be substantially constant.

On the other hand, if a defect exists such as a pin hole on the photosensitive layer on the photoreceptor means, when the contact charge is in contact with the defective portion on the surface of the photoreceptor means, the contact charger means is directly in contact with the electrically conductive base. When this occurs, a larger current flows from the contract charger means into the base compared with the case where no defect exists on the surface of the photoreceptor means. As a result, the voltage being applied to the photosensitive layer from the contact charge means drops.

The charge voltage drop detection means monitors the voltage being applied to the photosensitive layer from the contact charger means, and it outputs a detecting signal to the control means when the voltage has dropped below a reference voltage. Further, when the control means receives the detecting signal from the charge voltage drop detection means, the control means signals to stop the operation of the entire device.

According to the above arrangement of the electrophotographic printing machine, when a defect such as a pin hole exists on the photosensitive layer formed on the photoreceptor means, the operation of the entire device will be stopped. Therefore, unlike the conventional devices, the image forming process will not be continued with the defective portion on the photosensitive layer. As a result, the electrophotographic printing machine having the above arrangement permits to prevent beforehand the contact charger means from breaking down.

Furthermore, the present invention may be arranged so as to further include display means being controlled by the control means in addition to the above arrangement. With this arrangement, the control means signals the display means to display a message indicating to exchange the photoreceptor means based on a detecting signal input from the charge voltage drop detection means.

According to the above arrangement, when the device has stopped operating, the display means displays a message indicating to exchange the photoreceptor means. Therefore, the operator can recognize that the device has stopped operating due to a faulty photoreceptor means, and the operator can immediately exchange it with a new one.

In order to achieve the above object, another electrophotographic printing machine in accordance with the present invention is characterized in including: photoreceptor means including a photosensitive layer having a photoconductivity formed on a surface of an electrically conductive base being connected to ground; contact charger means in contact with the photosensitive layer for charging the photosensitive layer by applying thereto a voltage; transfer means in contact with the photosensitive layer for transferring a toner image formed on the surface of said photoreceptor means by applying a voltage to a copying material being sandwiched between the photoreceptor means and the transfer means; transfer voltage drop detection means for monitoring the voltage being applied to the photosensitive layer from the transfer means and for outputting a detecting signal to control means when the voltage has dropped below a reference voltage; and control means for controlling the operation of the device, wherein the control means signals to stop the operation of the device based on the detecting signal from the transfer voltage drop detection means.

According to the above arrangement, the transfer means is in contact with the photosensitive layer formed on the surface of the photoreceptor means so as to apply a voltage to the photosensitive layer when no copying material exists between the transfer means and the photoreceptor means.

In this arrangement, if no defect exists on the photosensitive layer on the photoreceptor means, voltage being applied to the photosensitive layer from the contract charger means will be substantially constant.

On the other hand, if a defect exists such as a pin hole on the photosensitive layer of the photoreceptor means, when the transfer means is in contact with the defective portion on the surface of the photoreceptor means, the transfer means is directly in contact with the electrically conductive base. When this occurs, a larger current flows from the transfer means into the base compared with the case where no defect exists on the surface of the photoreceptor means. As a result, the voltage being applied to the photosensitive layer from the transfer means drops.

The transfer voltage drop detection means monitors the voltage being applied to the photosensitive layer from the transfer means, and it outputs a detecting signal to the control means when the voltage has dropped below a reference voltage. Further, the control means signals to stop the operation of the entire device based on the detecting signal input from the transfer voltage drop detection means.

According to the above arrangement of the electrophotographic printing machine, when a defect such as a pin hole exists on the photosensitive layer formed on the photoreceptor means, the operation of the entire device will be stopped. Therefore, unlike the conventional devices, the image forming process will not be continued with the defective portion on the photosensitive layer. As a result, the electrophotographic printing machine having the above arrangement permits to prevent beforehand the contact charger means and the transfer means from breaking down.

In order to achieve the above object, another electrophotographic printing machine in accordance with the present invention is characterized in comprising: photoreceptor means including a photosensitive layer having a photoconductivity formed on a surface of an electrically conductive base being connected to ground; contact charger means in contact with the photosensitive layer for charging the photosensitive layer by applying thereto a voltage; current detection means for monitoring current flowing across the base and ground and for outputting a detecting signal to control means when the current becomes larger than a reference current; and control means for controlling the operation of the device, wherein the control means signals to stop the operation of the entire device when the control means receives the detecting signal from the current detection means.

In the above arrangement, the voltage is applied to the photosensitive layer formed on the surface of the photoreceptor means from the contact charger means. In this arrangement, if no detect exists on the photosensitive layer of the photoreceptor means, an electrical resistance of the photoreceptor means is substantially large, and a current flowing across the base of the photoreceptor means and ground is extremely small.

On the other hand, if a defect exists such as a pin hole on the photosensitive layer on the photoreceptor means, when the contact charger means is in contact with the defective portion on the surface of the photoreceptor means, the contact charger means is directly in contact with the electrically conductive base. When this occurs, a larger current flows between the base and ground compared with the case where no defect exists on the surface of the photoreceptor means.

The current detection means monitors the current flowing across the base and ground, and it outputs a detecting signal to the control means when the current becomes larger than a reference current. Further, when the control means receives the detecting signal from the current detection means, the control means signals to stop the operation of the entire device.

According to the above arrangement of the electrophotographic printing machine, when a defect such as a pin hole exists on the photosensitive layer formed on the photoreceptor means, the operation of the entire device will be stopped. Therefore, unlike the conventional devices, the image forming process will not be continued with the defective portion on the photosensitive layer. As a result, the electrophotographic printing machine having the above arrangement permits to prevent beforehand the contact charger means from breaking down.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a diagram showing an essential part of an electrophotographic printing machine in accordance with the first embodiment of the present invention.

FIG. 2 is a electronic circuit diagram showing a voltage drop detecting circuit of the electrophotographic printing machine.

FIG. 3 is a diagram showing a schematic configuration of the electrophotographic printing machine.

FIG. 4 is an explanatory view showing an arrangement of each sensor provided with the electrophotographic printing machine.

FIG. 5 is a diagram showing an essential part of an electrophotographic printing machine in accordance with the second embodiment of the present invention.

FIG. 6 is a electronic circuit diagram showing a voltage drop detecting circuit of the electrophotographic printing machine.

FIG. 7 is a diagram showing an essential part of an electrophotographic printing machine in accordance with the third embodiment of the present invention.

DESCRIPTION OF THE EMBODIMENTS

The following description will discuss an embodiment of the present invention with reference to FIGS. 1 through 4.

Figure 1:
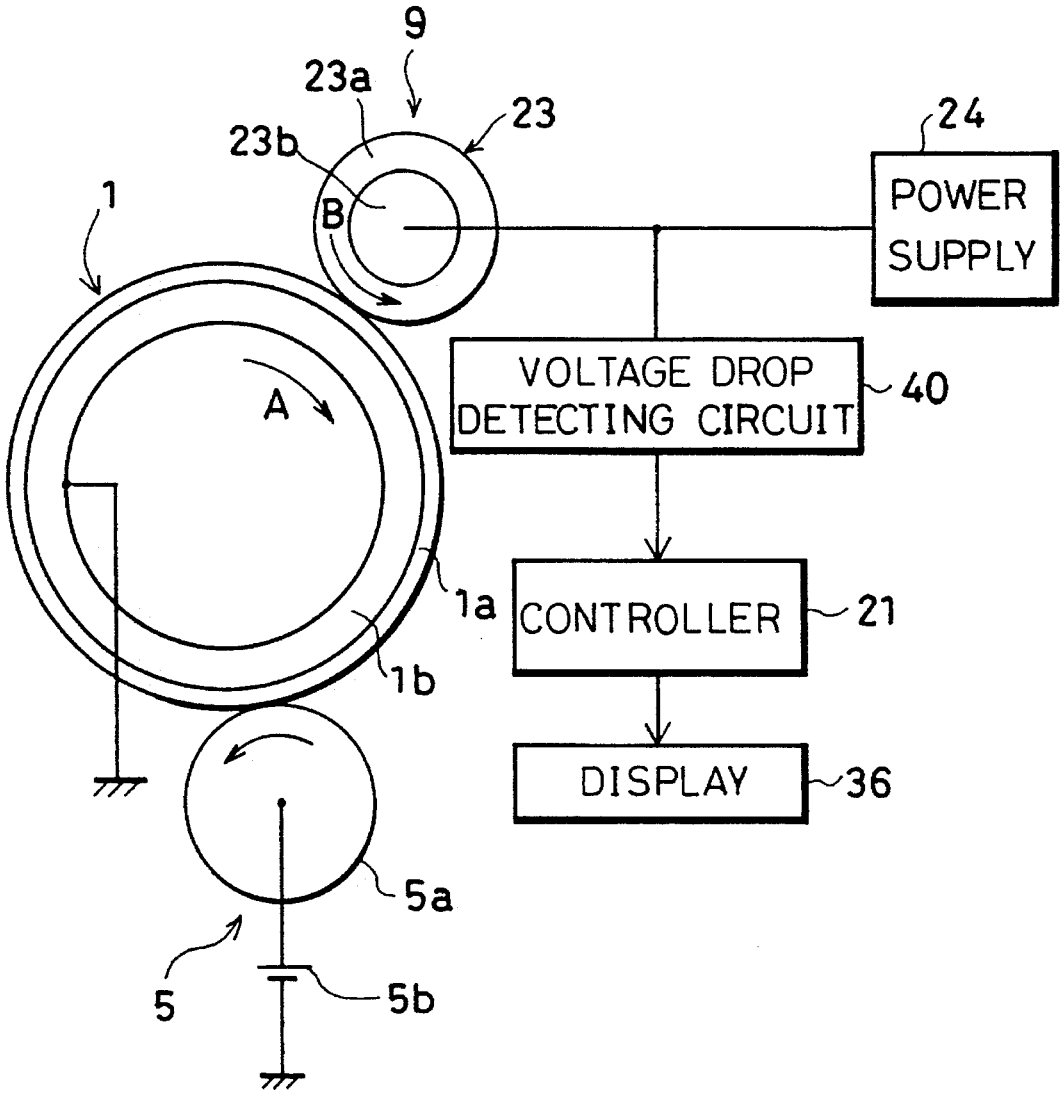
FIGS. 1 through 7 describe the present invention in detail.

As shown in FIG. 1, an electrophotographic printing machine in accordance with the present embodiment includes a photoreceptor drum 1 (photoreceptor means) having a photosensitive layer 1*a* formed on a peripheral surface of a cylindrical drum base 1*b*. The photoreceptor 1 is driven by drive means (not shown) so as to rotate in the direction of arrow A in the figure.

The photosensitive layer 1*a* formed on the surface of the photoreceptor 1 has a property as an insulator when it is not exposed. On the other hand, the photosensitive layer 1*a* has an electric property which makes an exposed portion thereof electrically conductive when it is exposed. For the photosensitive layer 1*a*, for example, a separated function type one having a double-layered structure of a carrier generation layer (CGL) and a carrier transport layer (CTL) may be adopted. The CGL is provided for generating an optical carrier by an projection of light beam. The CTL is provided for transporting the optical carrier. However, it should be noted that the structure of the photosensitive layer 1*a* is not limited to this type, for example, a single layered one may be used as well.

The drum base 1*b*, which is made of an electrically conductive material such as an aluminum alloy, is connected to ground so that a charge on the exposed portion of the photosensitive layer 1*a* is released to ground.

Figure 3:
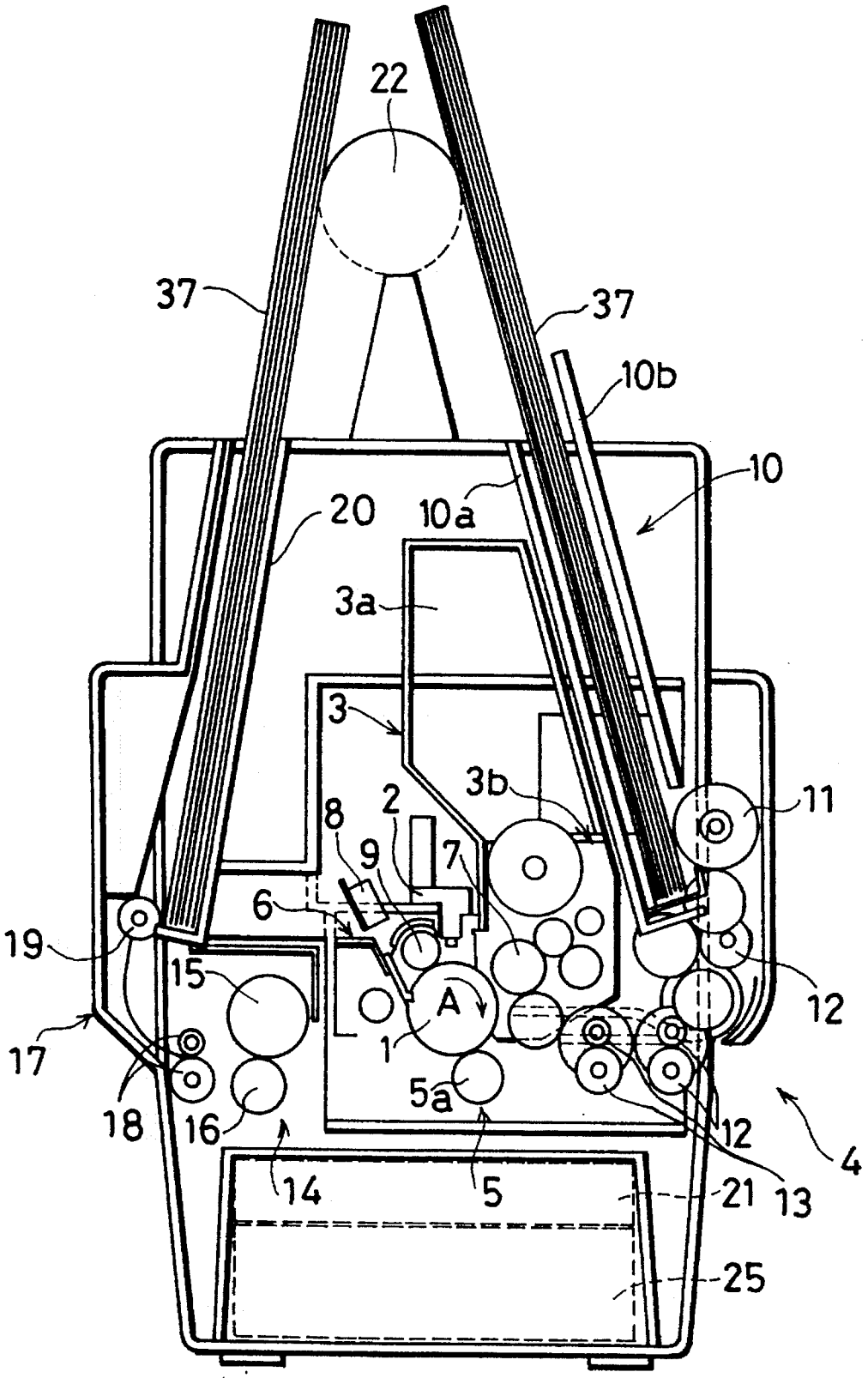

As shown in FIG. 3, an exposure unit 2 including a LED (Light Emitting Diode) head, a developer unit 3, a feed transport unit 4, a transfer unit 5 including a transfer roller 5*a*, a cleaning blade 6, an eraser 8, and a contact charger 9 are provided along the circumference of the photoreceptor 1.

The exposure unit 2 operates as follows. By projecting a light corresponding to an image on the document (not shown), a static latent image corresponding to the image on the document is formed on the photosensitive layer 1*a* of the photoreceptor drum 1, which is uniformly charged by the contact charger 9.

The developer unit 3 is provided with a toner tank 3*a* for storing a toner (not shown) and a developer vessel 3*b* including a fur brash roller 7 for supplying the toner on the surface of the photoreceptor drum 1. The developer unit 3 supplies the toner, stored in the developer vessel 3*b* after being transferred from the toner tank 3*a*, onto the surface of the photoreceptor drum 1 using the fur brush roller 7. As a result, the toner adheres to the static latent image formed on the surface of- the photoreceptor drum 1, thereby developing (visualizing) the static latent image to be a toner image.

In the present embodiment, a voltage, that is close to and has the same polarity as the charged potential of the photoreceptor drum 1, is applied to the fur brush roller 7. As a result, the toner supplied onto the surface of the photoreceptor drum 1 by the fur brush roller 7 is charged so as to have the same polarity as the charged potential of the photoreceptor drum 1. Namely, a reversed developing method is adopted in the electrophotographic printing machine of the present embodiment. Thus, the static latent image formed on the surface of the photoreceptor drum 1 is a static latent image formed by removing the charge on the image portion (a so-called negative latent image).

Alternatively, another method (normal developing method) may be adopted in the electrophotographic printing machine as well wherein the static latent image is formed without removing the charge on the image portion (a so-called positive latent image), and the toner, charged so as to have an opposite polarity to the static latent image, adheres to the static latent image.

The feed transport unit 4 includes a feed roller 11, a plurality of transport rollers 12 and a register roller 13. The above rollers form a feed transport path which extends from the feed cassette 10 to a contacting portion between the photoreceptor drum 1 and the transport roller 5 (to be described later). The feed transport unit 4 is arranged as follows. A copying material 37 stored in the feed cassette 10 is taken out by the feed roller 11. Then, the copying material 37 is transported to the register roller 13 by the transport roller 12. The register roller 13 adjusts the transporting timing of the copying material 37, and the copying material 37 is fed to the contacting portion between the photoreceptor drum 1 and the transfer roller 5*a* synchronous with the formation of the toner image on the surface of the photoreceptor drum 1.

The feed cassette 10 is composed of a bottom plate 10*a* and a cover plate 10*b*. The length of the feed cassette 10 is set shorter than the length of the copying material 37 in the feed direction by substantially ⅓ considering the convenience in adding more copying material 37 when running out of the copying material 37.

As shown in FIG. 1, the transfer unit 5 is provided with the transfer roller 5*a* and a power supply 5*b*. The transfer roller 5*a* is made of an electrically conductive and elastic material (such as electrically conductive rubber). The power supply 5*b* is provided for applying a predetermined DC voltage, which has an opposite polarity to the charge of the toner, to the transfer roller 5*a*. The transfer roller 5*a* is in contact with the surface of the photoreceptor drum 1 so that the copying material 37 fed from the feed transfer unit 4 is sandwiched between the photoreceptor drum 1, having the toner image formed on the surface thereof, and itself.

In the present embodiment, for a transfer unit which transfers the toner image formed on the surface of the photoreceptor drum 1, the transfer unit 5 including the transfer roller 5*a* has been employed. However, the present invention is not intended to be limited to this. Other than the transfer unit 5, for example, a corona transfer unit may be employed which carries out a corona-discharge by applying a charge, having an opposite polarity to the charge of the toner, onto the back surface of the copying material 37.

As shown in FIG. 3, the cleaning blade 6 in contact with the photoreceptor drum 1 operates as follows. With the rotation of the photoreceptor drum 1 in the direction of A, the toner remaining on the photoreceptor drum 1 is separated therefrom, thereby cleaning the surface of the photoreceptor drum 1. The eraser 8 removes the toner remaining on the surface of the photoreceptor drum 1 by projecting a light on the surface of the photoreceptor drum 1.

The electrophotographic printing machine is further provided with a fuser 14, a discharge transfer unit 17 and a discharge tray 20. The toner image that has been transferred to the copying material 37 is made to permanently adhere thereto by the fuser 14. Then, the copying material 37 is discharged out of the device by the discharge transfer unit 17.

The fuser 14 includes a heat roller 15 for heating up the toner image that has been transferred onto the copying material 37, and a pressure roller 16 for pressing the copying material 37 onto the heat roller 15. While being passed through the heat roller 15 and the pressure roller 16, heat and pressure are applied to the copying material 37 whereon the toner image has been transferred by the transfer unit 5. As a result, the toner image is made to permanently adhere to the copying material 37.

The discharge transfer unit 17 includes the transfer roller 18 and the discharge roller 19. These rollers form a discharge transport path which extends from the fuser 14 to the discharge tray 20.

The length of the discharge tray 20 is set shorter than the length of the copying material 37 in the feed direction by substantially ⅓ considering the convenience in taking out the copying material 37. The feed cassette 10 and the discharge cassette 20 are placed so as to confront one another and form a reversed V shape sandwiching a handle 22 provided at the center of the main body. According to the above arrangement, since neither the feed cassette 10 nor the discharge cassette 20 is projected from the side of the device, the device can be made compact and easy to carry.

The contact charger 9 is provided between the eraser 8 and the exposure unit 2 on the peripheral surface of the photoreceptor drum 1. As shown in FIG. 1, the contract charger 9 includes charge rollers 23 and the power supply 24 for applying DC voltage between the charge rollers 23. The charge roller 23 is arranged such that an electrically conductive elastic layer 23*a* is formed on a surface of an electrically conductive cylindrical roller base 23*b* made of an electrically conductive material such as a metal. The electrically conductive elastic layer 23*a* is preferably made of a silicone rubber including a carbon.

The charge roller 23 is freely rotative around an axis parallel to the rotation axis of the photoreceptor drum 1. Further, the charge roller 23 is in contact with the surface of the photoreceptor drum 1 with a predetermined nip width. The charge roller 23 is rotated in the direction of arrow B in conjunction with the rotation of the photoreceptor drum 1 in the direction of arrow A in the figure.

Figure 2:
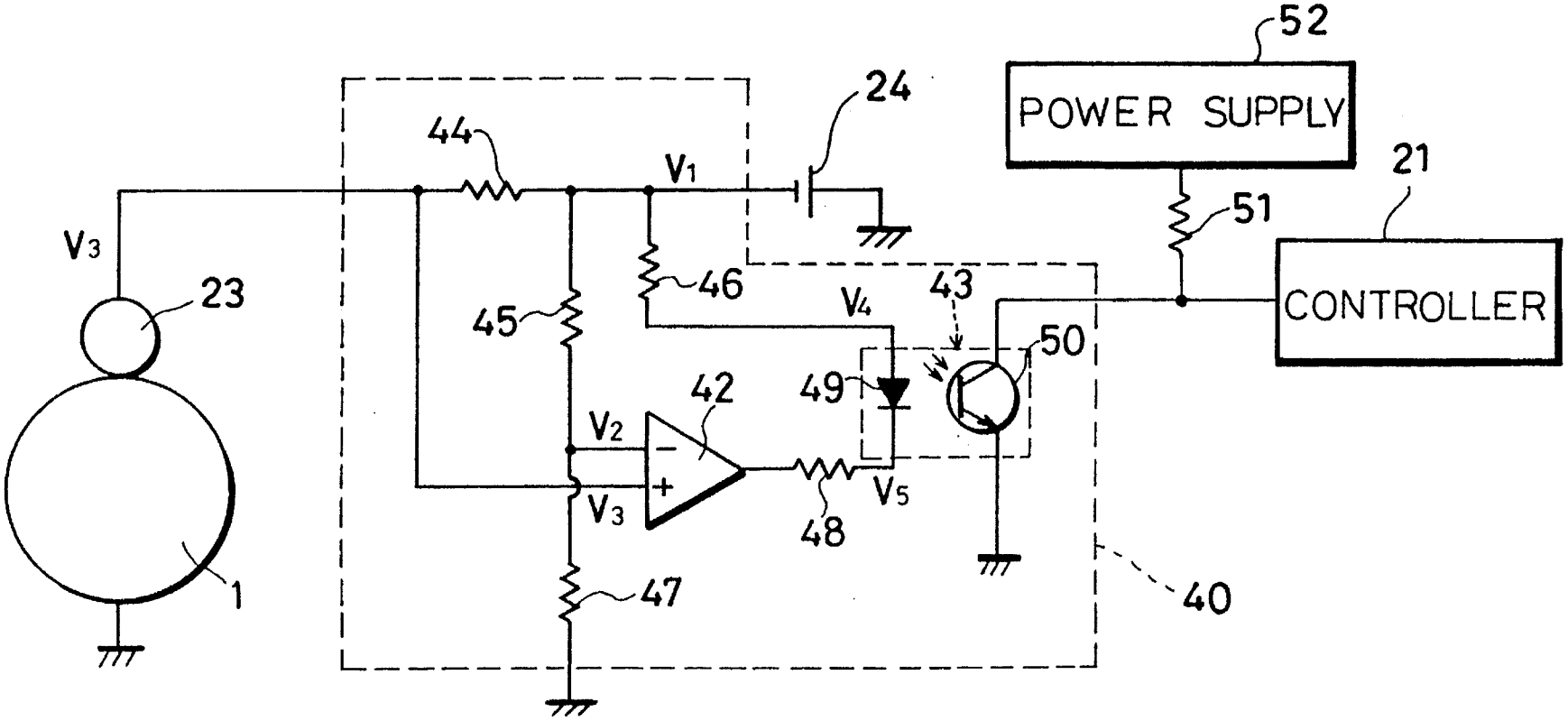

As shown in FIG. 2, the negative terminal of the power supply 24 is connected to the roller base 23*b* of the charge roller 23 through an electric resistor 44, and the positive terminal of the power supply 24 is connected to ground. DC voltage is applied to a photosensitive layer 1*a* of the surface of the photoreceptor drum 1 from the power supply 24 through the charge roller 23, thereby negatively charging the photosensitive layer 1*a*. In addition, the power supply 24 is controlled by a controller 21 (to be described later) so that the voltage $V_1$ output therefrom is always constant. In this way, a constant voltage $V_3$ is always applied to the charge roller 23 from the power supply 24 through the electric resistor 44 as long as no defect such as a pin hole exists on the photosensitive layer 1*a* of the photoreceptor drum 1.

On the other hand, in the case of positively charging the photosensitive layer 1*a* of the photoreceptor drum 1, the positive terminal of the power supply 24 is connected to the charge roller 23, and the negative terminal is connected to ground.

As shown in FIG. 3, a main body power source 25 which supplies a power to each component of the device and the controller 21 (control means) for controlling respective operations by the components is placed under the electrophotographic printing machine. In addition, the electrophotographic printing machine is provided with a display which is controlled by the controller 21.

Figure 4:
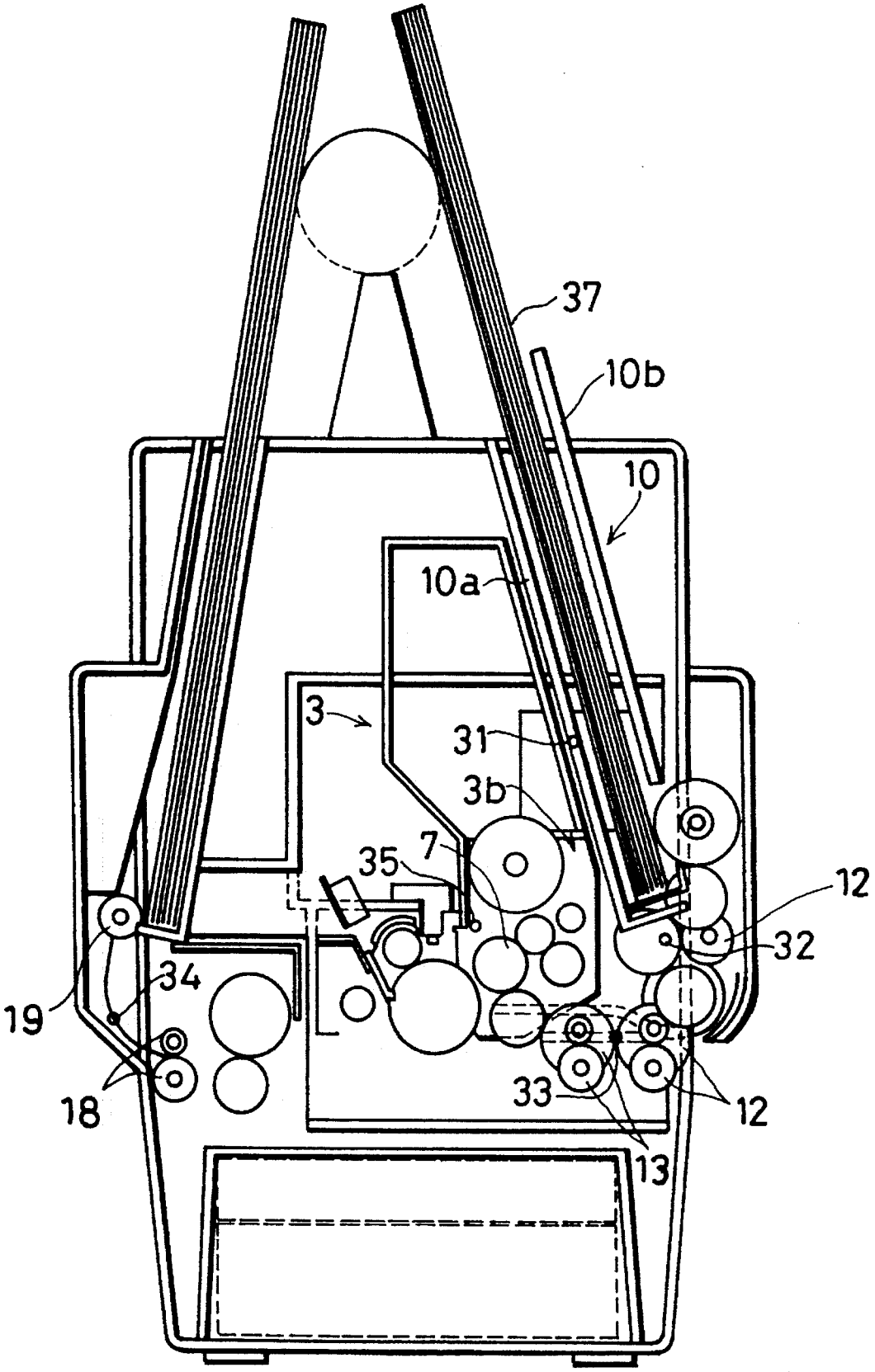

As shown in FIG. 4, the electrophotographic printing machine of the present embodiment is provided with various sensors for various controls as described below. A sheet detection sensor 31 for detecting whether or not the copying material 37 exists in the feed cassette 10 is provided on the bottom plate 10*a* of the feed cassette 10. A paper stuck detecting sensor 32 for detecting the copying material 37 being stuck in the device is provided in the vicinity of the transfer roller 12. Further, a paper feed detecting sensor for detecting that the copying material 37 is fed into the device is provided between the transfer roller 12 and the register roller 13. A paper discharge detecting sensor for detecting that the copying material 37 is discharged out of the device is provided in the vicinity of the discharge roller 19. Further, a toner detecting sensor 35 for detecting whether or not the toner is supplied to the fur brush roller 7 is provided in the developer vessel 3*a* of the developer unit 3.

As shown in FIG. 2, the charge roller 23 (charging component) of the contact charger 9 is connected to a voltage drop detecting circuit 40 (charge voltage drop detection means) for detecting that the voltage being applied to the charge roller 23 from the power supply 24 through the electric resistor 44 has dropped below a predetermined voltage. As shown in FIG. 1, the voltage drop detecting circuit 40 is connected to the controller 21, and is designed such that when it is detected that the voltage of the charge roller 23 has dropped below the reference voltage $V_2$ (to be described later), a detecting signal is output to the controller 21. When the controller 21 receives the detecting signal from the voltage drop detecting circuit 40, the controller 21 signals the main body to stop operating, and signals the display unit 36 to display a message indicating to exchange the photoreceptor drum 1 immediately or after the image forming process has been completed.

The following will describe the voltage drop detecting circuit 40 in detail. As shown in FIG. 2, the voltage drop detecting circuit 40 includes a comparator 42 (level detection means) composed of an operational amplifier, etc., a photo coupler 43 (switching means) having a light emitting diode 49 and a photo transistor 50, and a plurality of electric resistors 44 through 48.

A comparator 42 has a negative input terminal through which the reference voltage is to be applied, a positive input terminal and an output terminal. The comparator 42 serves as a level detector for comparing the voltage being applied to the positive input terminal with the reference voltage. In the present embodiment, the voltage $V_1$ from the power supply 24, which has been level controlled by the controller 21, is divided by the resistors 45 and 47, to be a voltage $V_2$. The obtained voltage $V_2$ is applied to the negative input terminal of the comparator 42 as a reference voltage. Additionally, another power supply (not shown) for applying the reference voltage to the negative input terminal may be connected to the negative input terminal of the comparator 42.

The positive input terminal of the comparator 42 is connected to the charge roller 23, and the voltage $V_3$ being applied to the charge roller 23 from the power supply 24 via the electric resistor 44 is applied to the positive input terminal.

The output terminal of the comparator 42 is connected to a cathode of the light emitting diode 49 which constitutes the photo coupler 43 via the electric resister 48. Further, the anode of the light emitting diode 49 is connected to the power supply 24 via the electric resistor 46. Additionally, a power supply (not shown) separately provided for applying a constant reference voltage to the anode of the light emitting diode 49 may be connected.

When a voltage $V_5$ applied to the cathode from the comparator 42 through the resistor 48 becomes lower than the constant voltage $V_4$ to be applied to the anode of the light emitting diode 49, a current flows across the anode and the cathode, thereby emitting a light, and turning ON a photo transistor 50.

The emitter of the photo transistor 50 is connected to ground, and the comparator 42 thereof is connected to the input terminal of the controller 21. In other words, the comparator 42 and the controller 21 are set electrically dielectric by the photo coupler 43.

A power supply 52 is connected to the line connecting the photo transistor 50 and the controller 21 via an electric resistor 51. Therefore, when the photo transistor 50 is turned OFF, a high level signal is input to the input terminal of the controller 21. Then, when the photo transistor 50 is turned ON, a detecting signal of low level is input through the input terminal of the controller 21.

In the voltage drop detecting circuit 40, when the voltage $V_3$ of the charge roller 23 being applied to the positive input terminal has dropped below the reference voltage $V_2$ to be applied to the negative input terminal of the comparator 42, the voltage $V_5$ being applied to the cathode becomes lower than the constant voltage $V_4$ being applied to the anode of the light emitting diode 49. As a result, the light emitting diode 49 is activated, and the photo transistor 50 is turned ON.

When no defect exists on the photosensitive layer 1*a* of the photoreceptor drum 1, the electrical resistance of the photosensitive layer 1*a* is substantially large. Therefore, when the surface of the photoreceptor drum 1 is being charged by the contact charger 9, the current flowing across the charge roller 23 and the drum base 1*b* through the photosensitive layer 1*a* via the photosensitive layer 1*a* is extremely small. In the present embodiment, the surface of the photoreceptor drum 1 is charged to −600 V by the contact charger 9, and a current of substantially 10 μA flows in the drum base 1*b*. Additionally, the current flowing in the drum base 1*b* differs depending on the shape and the material used in the photoreceptor drum 1 and the charge roller 23, or depending on the rotation speed of the photoreceptor drum 1.

On the other hand, in the case where a defect which is greater than 0.01 $mm^2$ exists, and the drum base 1*b* is exposed is described below. When the charge roller 23 is in contact with the defective portion of the photoreceptor drum 1, the charge roller 23 and the electrically conductive drum base 1*b*. As a result, the electric resistance of the photoreceptor drum 1 drops, and the current flowing in the base 1*b* increases. Consequently, a voltage drop in the resistor 44 increases, thereby lowering the voltage $V_3$ being applied to the charge roller 9.

In order to counteract this, the reference voltage $V_2$ being applied to the negative input terminal of the comparator 42 is set such that the voltage $V_3$ being applied to the charge roller 9 becomes higher than the reference voltage $V_2$ when a current larger than a predetermined current flows in the drum base 1*b* (for example in the case where a current of substantially 30 μA flows in the drum base 1*b* when charging the surface of the photoreceptor drum 1 to −600 V by the contact charger 9.) In the present embodiment, the reference voltage $V_2$ can be set by setting the respective electric resistances for the electric resistors 45 and 47 appropriately.

The following will discuss the image forming process by the electrophotographic printing machine of the present embodiment.

First, the photoreceptor drum 1 is driven by a drive unit (not shown) and is rotated in the direction of A at a predetermined speed. With the rotation of the photoreceptor drum 1, the charge roller 23 is drive so as to rotate in the direction of B. DC voltage $V_3$ is applied to the charge roller from the power supply 24 via the electric resistor 44. As the charge is moved onto the photoreceptor layer 1*a* of the photoreceptor drum 1, the photosensitive layer 1*a* is charged. In more detail, the photosensitive layer 1*a* is charged through these ways: triboelectric charging by friction between the photosensitive layer 1*a* and the charge roller 23, charge injection charging wherein the charges are directly transferred from the charge roller 23 to the photosensitive layer 1*a* and gaseous discharging. The gaseous discharging takes place in a microscopic space between the charge roller 23 and the photosensitive layer 1*a* in the vicinity of the contact area.

After the photosensitive layer 1*a* of the photoreceptor drum 1 is uniformly charged by the contact charger 9, it is exposed by the exposure unit 2, and a static latent image is formed on the photosensitive layer 1*a*. Then, the static latent image is developed by the developer unit 3, thereby forming a toner image on the surface of the photoreceptor drum 1.

Thereafter, the toner image is superimposed on the copying material 37 fed by the feed transport unit 4. As the copying material 37 passes through the contacting area between the transfer roller 5*a* and the photoreceptor drum 1, the toner image is transferred onto the copying material 37. The voltage having an opposite polarity to the toner is applied to the transfer roller 5*a*.

Then, after the copying material 37 is separated from the photoreceptor drum 1, the copying material 37 passes through the contacting portion between the heat roller 15 and the pressure roller 16 of the fuser 14. As a result, the toner image is transferred onto the copying material 37 to be permanently affixed thereto. Then, the copying material 37 is discharged out of the device by a discharge transport unit 17.

The cleaning blade 6 removes the residual toner remaining on the surface of the photoreceptor 1 after the transfer. Similarly, the charge on the static latent image is electrostatically eliminated by the eraser 8. The electrophotographic printing machine repeats the above process, i.e., from the charging by the contact charger 9 to the electrostatical elimination done by the eraser, thereby successively forming images.

Additionally, when charging the surface of the photoreceptor drum 1 by the contact charger 9, if a defect exists on the photosensitive layer 1*a* of the photoreceptor drum 1, a constant voltage $V_3$ that is higher than the reference voltage $V_2$ is applied to the charge roller 23 from the power supply 24 through the electric resistor 44. Thus, the photo coupler 43 of the voltage drop detecting circuit 40 is not activated.

However, if a defect exists such as a pin hole on the photosensitive layer 1*a* of the photoreceptor drum 1, the electric resistance of the photoreceptor drum 1 drops when the charge roller 23 is in contact with the defective portion of the photoreceptor drum 1. As a result, the voltage $V_3$ to be applied to the charge roller 23 also drops. In such a case, the voltage $V_3$ being applied to the charge roller 9 becomes greater than the reference voltage $V_2$ being applied to the negative input terminal of the comparator 42 of the voltage drop detecting circuit 40. As a result, the voltage $V_5$ being applied to the cathode of the light emitting diode 49 from the comparator 42 through the resistor 48 becomes greater than a constant voltage $V_4$ to be applied to the anode of the light emitting diode 49, and the photo coupler 43 for emitting the light emitting diode 49 is thus operated. Namely, the light emitting diode 49 is activated, and the photo transistor 50 is turned ON. As a result, the low level detecting signal is input through the input terminal of the controller 21.

When the detecting signal is input, the operation of the device is controlled by the controller 21 as described below.

After the power supply for the electrophotographic printing machine is turned ON, if the detecting signal is input to the controller 21 before the device is set in a wait-state ready for forming images, the controller 21 immediately signals to stop the operation of the entire device except the display 36, and it signals the display 36 to display a message indicating to exchange the photoreceptor drum 1.

Furthermore, after the device is set in a wait-state, if the detecting signal is input to the controller 21 in an execution of a sequential image forming process, the controller 21 operates as follows. First, the controller 21 signals to complete the current image forming process. Next, the controller 21 signals to stop the operation of the entire device except the display 36, and it signals the display 36 to display a message indicating to exchange the photoreceptor drum 1.

Alternatively, the controller 21 may be designed such that even in the execution of the sequential image forming process, if the detecting signal is input to the controller 21 from the voltage drop detecting circuit 40, the controller 21 immediately signals to stop the operation of the entire device except the display 36, and it signals the display 36 to display a message indicating to exchange the photoreceptor drum 1.

Figure 9:
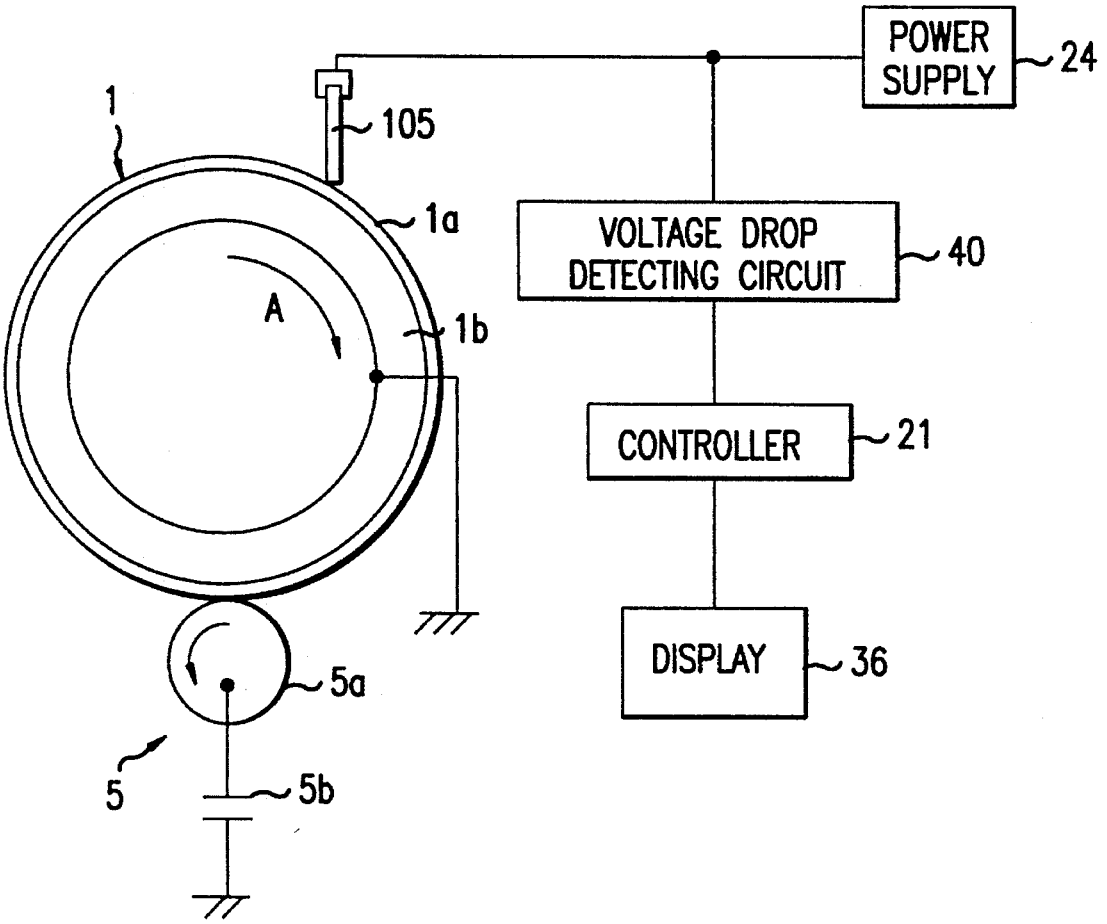
FIG. 9 is a diagram showing the use of a blade-shaped charging member.

In the discussed preferred embodiment, the charge roller 23 has been employed as a charging member. However, other types of charging member may be equally adopted. For a charging member other than the charge roller 23, a brush-shaped or blade-shaped one such as blade-shaped member 105 as shown in FIG. 9, is preferably adopted.

Additionally, the contact charger in the discussed preferred embodiment is designed for use in an electrophotographic printing machine. As a concrete example, it is preferably used in a copying machine or a laser printer.

As described, the electrophotographic printing machine in accordance with the present embodiment is provided with photoreceptor means including a photosensitive layer having a photoconductivity formed on a surface of an electrically conductive base being connected to ground; contact charging means in contact with the photosensitive layer for charging the photosensitive layer by applying thereto a voltage; charge voltage drop detection means for monitoring the voltage being applied to the photosensitive layer from the contact charger means, and outputting a detecting signal to control means when the voltage has dropped below the reference voltage; and control means for controlling the operation of the device, wherein the control means signals to stop the operation of the entire device when a detecting signal is input from the charge voltage drop detection means.

According to the above arrangement, when a defect exists such as a pin hole on the photosensitive layer of the photoreceptor means, the operation of the device will be stopped. Therefore, unlike the conventional devices, the image forming process will not be continued with the defective portion on the photosensitive layer. This permits to prevent beforehand the contract charger means from breaking down.

In addition to the above components, the electrophotographic printing machine in accordance with the present embodiment may be provided with display means which is controlled by the control means such that when a detecting signal is input from the charge voltage drop detection means, the display means displays a message indicating to exchange the photoreceptor means.

With this arrangement, the operator can recognize that the device has stopped operating due to a faulty photoreceptor means, and the operator can immediately exchange it with a new one.

Figure 5:
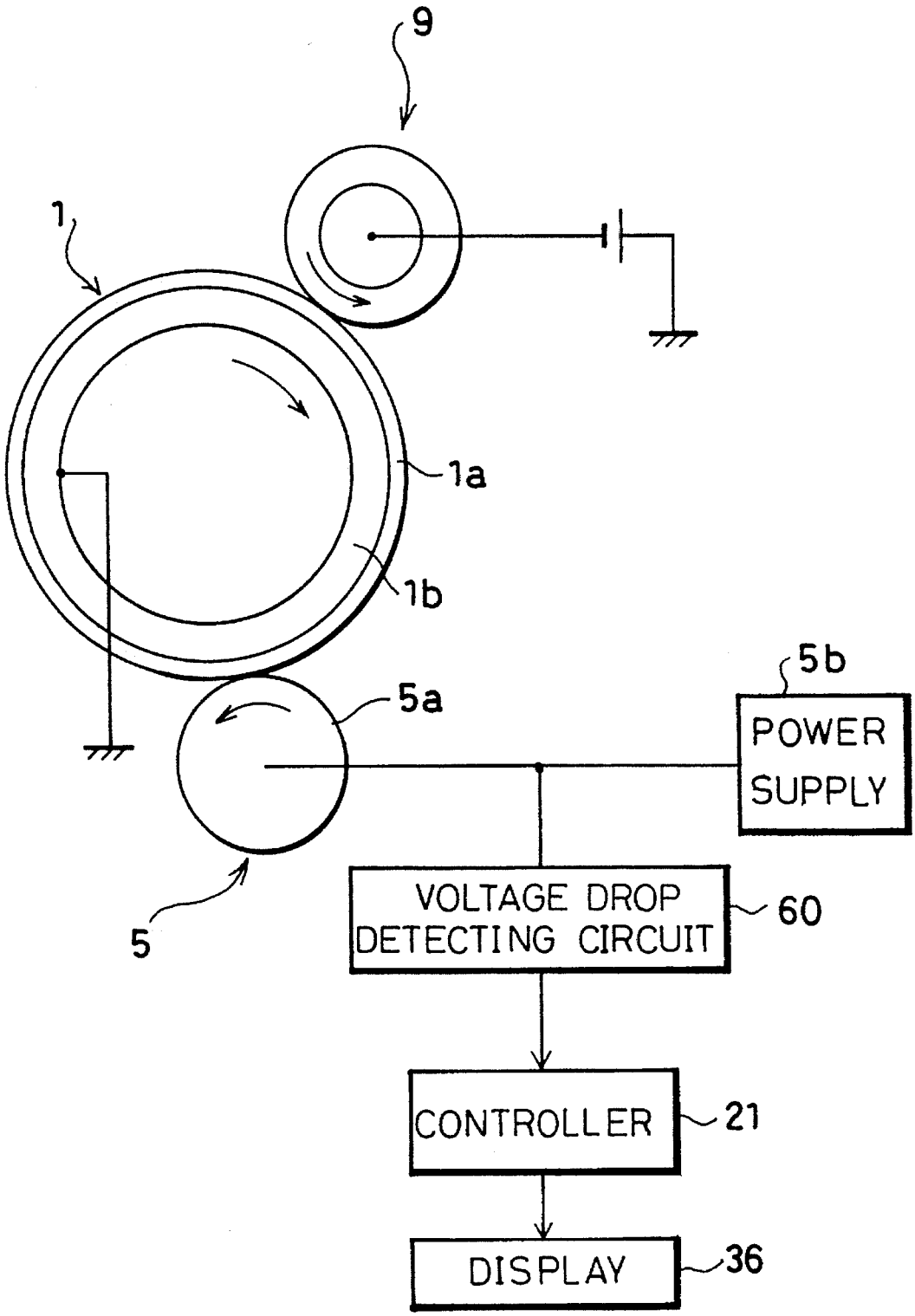
Figure 6:
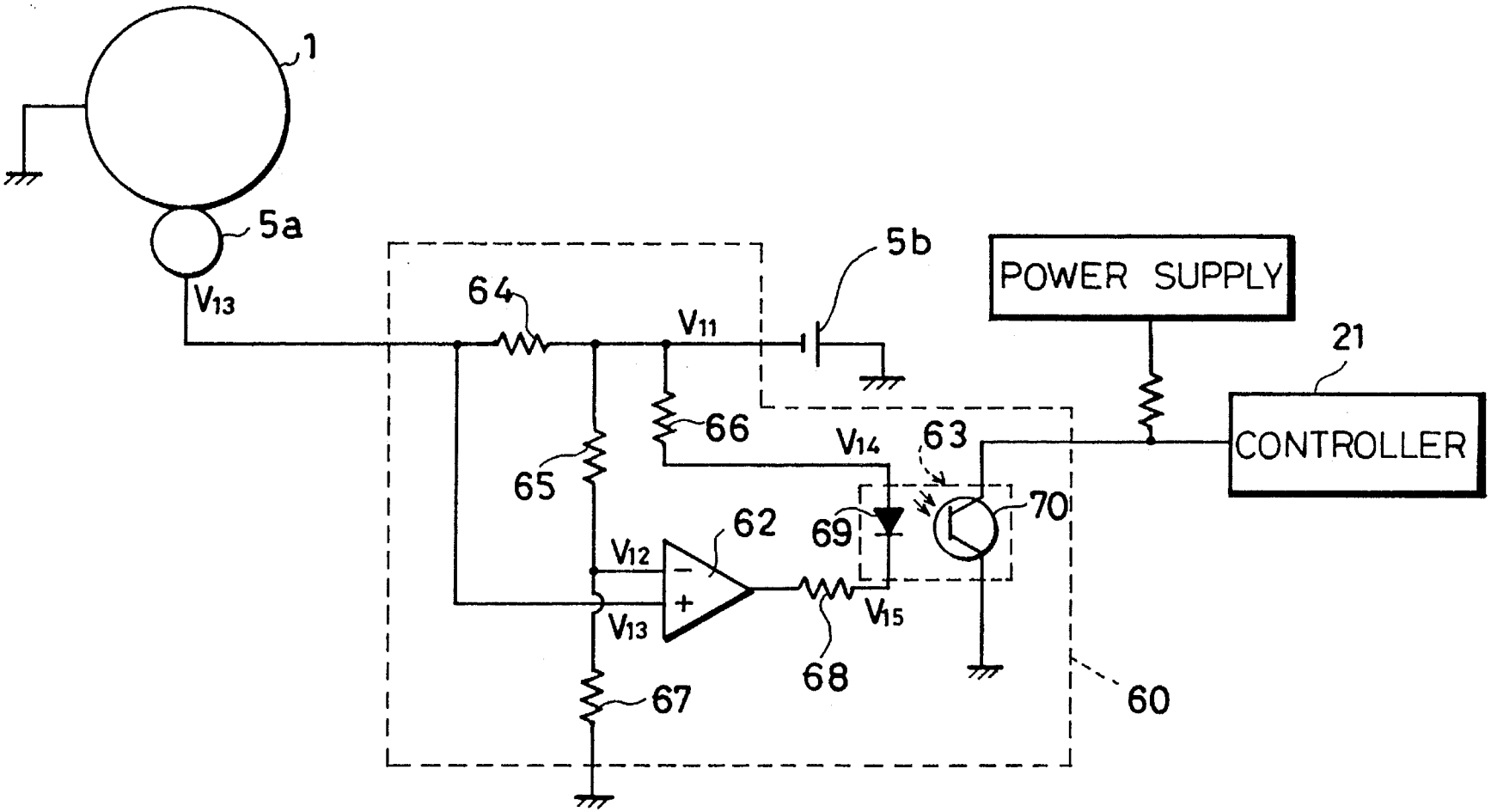

The following description will discuss the second embodiment of the present invention with reference to FIGS. 5 and 6. An electrophotographic printing machine of the present embodiment has the same configuration as the electrophotographic printing machine of the first embodiment except the voltage drop detecting circuit 40. Thus, other members having the same functions as in the first embodiment will be designated by the same codes and their descriptions will be omitted.

In the present embodiment, a voltage drop detecting circuit 60 (transfer voltage drop detection means) is connected to the transfer roller 5*a* (transfer member) of the transfer unit 5 as shown in FIG. 6. The voltage drop detecting circuit 60 detects that a voltage $V_{13}$ being applied to the transfer roller 5*a* from the power supply 5*b* via the electric resistor 64 has dropped below a predetermined value. The voltage drop detecting circuit 60 is connected to the controller 21 (control means), and it outputs a detecting signal to the controller 21 when it detects that the voltage of the transfer roller 5*a* has dropped below a reference voltage $V_{12}$ (to be described later).

The voltage drop detecting circuit 60 includes a comparator 62 (level detection means) mainly composed of an operational amplifier, a photo coupler 63 (switching means) having a light emitting diode 69 and a photo transistor 70, and a plurality of electric resistors 64 through 68. Here, the comparator 62 and the photo coupler 63 respectively have the same configurations and functions as the comparator 42 and the photo coupler 43 of the voltage drop detecting circuit 40 in the first embodiment. Thus, the descriptions thereof shall be omitted here.

In the present embodiment, the voltage $V_{11}$ output from the power supply 5*b*, which has been level controlled by the controller 21, is divided by the resistors 65 and 67. The obtained voltage $V_{12}$ is applied to the negative input terminal of the comparator 62 as a reference voltage. Additionally, another power supply (not shown) for applying the reference voltage to the negative input terminal may be connected to the negative input terminal of the comparator 62.

The positive input terminal of the comparator 62 is connected to the transfer roller 5*a*, and the voltage $V_{13}$ being applied to the transfer roller 5*a* from the power supply 5*b* via the electric resistor 64 is applied to the positive input terminal of the comparator 62.

The output terminal of the comparator 62 is connected to a cathode of the light emitting diode 69 which constitutes the photo coupler 63 via the electric resister 68. Further, the anode of the light emitting diode 69 is connected to the power supply 5*b* via the electric resistor 66. Therefore, a constant voltage $V_{14}$ corresponding to the voltage $V_{11}$ from the power supply 5*b* and the electric resistance of the electric resister 66 is applied to the anode of the light emitting diode 69. Additionally, another power supply (not shown) for applying a constant reference voltage to the cathode of the light emitting diode 69 may be connected to the anode of the light emitting diode 69.

In the voltage drop detecting circuit 60, when the voltage $V_{13}$ of the transfer roller 5*a* being applied through the positive input terminal of the comparator 62 has dropped below the reference voltage $V_{12}$ being applied to the negative input terminal of the comparator 62, the voltage $V_{15}$ being applied to the cathode becomes lower than the constant voltage $V_{14}$ being applied to the anode of the light emitting diode 69. As a result, the light emitting diode 69 is activated, and the photo resistor 70 is turned ON.

As long as no defect exists on the photosensitive layer 1*a* of the photoreceptor drum 1, the electrical resistance of the photosensitive layer 1*a* is substantially large. Therefore, the current flowing across the transfer roller 5*a* and the drum base 1*b* via the photosensitive layer 1*a* is extremely small. In the present embodiment, a current flowing in the circuit composing of the power supply 5*b* whose negative terminal is connected to ground, the electric resistor 66, the transfer roller 5*a*, and the photoreceptor drum 1 having the drum base 1*b* being connected to ground is set substantially 3 μA. Additionally, the current flowing in the circuit differs depending on the shape and the material used in the photoreceptor drum 1 and the transfer roller 5*a*, or depending on the rotation speed of the photoreceptor drum 1.

On the other hand, the case where a defect which is greater than 0.01 $mm^2$ exists on the photosensitive layer 1*a* of the photoreceptor drum 1, and the drum base 1*b* is exposed will be described below. When the transfer roller 5*a* is in contact with the defective portion of the photoreceptor drum 1, there will be a continuity between the transfer roller 5*a* and the electrically conductive drum base 1*b*. As a result, the electrical resistance of the photoreceptor drum 1 drops, and a current flows in the circuit increases. Consequently, a voltage drop in the resistor 64 increases, thereby lowering the voltage $V_{13}$ being applied to the transfer roller 5*a*.

In order to counteract this, the reference voltage $V_{12}$ being applied to the negative input terminal of the comparator 62 is set such that the voltage $V_{13}$ being applied to the transfer roller 5*a* becomes higher than the reference voltage $V_{12}$ when more than a predetermined current flows in the circuit (for example in the case where a current of substantially 10 μA flows in the circuit). In the present embodiment, the reference voltage $V_{12}$ can be set by setting the respective electrical resistances for the electric resistors 65 and 67 appropriately.

If no defect exists on the photosensitive layer la of the photoreceptor drum 1, a constant voltage $V_{13}$ that is higher than the reference voltage $V_{12}$ is applied to the transfer roller 5*a* from the power supply 5*b* via the electric resistor 64. Thus, the photo coupler 63 of the voltage drop detecting circuit 60 is not activated. This means that a high level signal is always input through the input terminal of the controller 21.

However, if a defect exists such as a pin hole on the photosensitive layer 1*a* of the photoreceptor drum 1, the electric resistance of the photoreceptor drum 1 drops when the transfer roller 5*a* is in contact with the defective portion of the photoreceptor drum 1. As a result, the voltage $V_{13}$ to be applied to the transfer roller 5*a* also drops. In such a case, the voltage $V_{13}$ being applied to the transfer roller 5*a* becomes higher than the reference voltage $V_{12}$, and the photo coupler 63 in the voltage drop detecting circuit 60 is activated. Namely, the light emitting diode 69 is activated, and the photo transistor 70 is turned ON. As a result, the low level detecting signal is input through the input terminal of the controller 21.

When the detecting signal is input from the voltage drop detecting circuit 60, the operation of the device is controlled by the controller 21 as described below.

With the ON state of the power supply for the electrophotographic printing machine, when the detecting signal is input to the controller 21 before the device is set in a wait-state ready for forming images, the controller 21 immediately signals to stop the operation of the entire device except the display 36 (see FIG. 5), and it signals the display 36 to display a message indicating to exchange the photoreceptor drum 1.

Furthermore, after the device is set in a wait state, if the detecting signal is input to the controller 21 in an execution of a sequential image forming process, the controller 21 operates as follows. First, the controller 21 signals to complete the current image forming process. Next, the controller 21 signals to stop the operation of the entire device except the display 36, and it signals the display 36 to display a message indicating to exchange the photoreceptor drum 1.

Alternatively, the controller 21 may be designed such that even in the execution of the sequential image forming process, when the detecting signal is input to the controller 21, the controller 21 immediately signals to stop the operation of the entire device except the display 36, and it signals the display 36 to display a message indicating to exchange the photoreceptor drum 1.

As described, according to the electrophotographic printing machine of the present embodiment, when a defect exists such as a pin hole on the photosensitive layer 1*a* of the photoreceptor drum 1, the operation of the device will be stopped. Therefore, unlike the conventional devices, the image forming process will not be continued with the defective portion on the photosensitive layer 1*a*. This permits to prevent beforehand the contract charger 9 and the transfer unit 5 from breaking down.

In addition, a photo copying machine or a laser printer is preferably used for the electrophotographic printing machine of the present embodiment.

As described, the electrophotographic printing machine in accordance with the present embodiment which is provided with photoreceptor means including a photosensitive layer having a photoconductivity formed on a surface of an electrically conductive base being connected to ground; contact charging means in contact with the photosensitive layer for charging the photosensitive layer by applying thereto a voltage; transfer means for transferring a toner image formed on the surface of the photoreceptor means to the copying material by applying voltage to the copying material being sandwiched between the photoreceptor means and itself; transfer voltage drop detection means for monitoring the voltage being applied to the photosensitive layer from the transfer means when the copying material does not exist between the transfer means and the photoreceptor means, and for outputting a detecting signal to control means when the voltage has dropped below a reference voltage; and control means for controlling the operation of the device, wherein the control means signals to stop the operation of the entire device when detecting signal is input from the voltage drop detection means.

According to the above arrangement, when a defect exists such as a pin hole on the photosensitive layer of the photoreceptor means, the operation of the device will be stopped. Therefore, unlike the conventional devices, the image forming process will not be continued with the defective portion on the photosensitive layer. This permits to prevent beforehand the contract charger means from being breaking down.

In addition to the above components, the electrophotographic printing machine in accordance with the present embodiment may be provided with display means which is controlled by the control means such that when a detecting signal is input from the charge voltage drop detection means, the display means displays a message indicating to exchange the photoreceptor means.

With this arrangement, the operator can recognize that the device has stopped operating due to a faulty photoreceptor means, and the operator can immediately exchange it with a new one.

Figure 7:
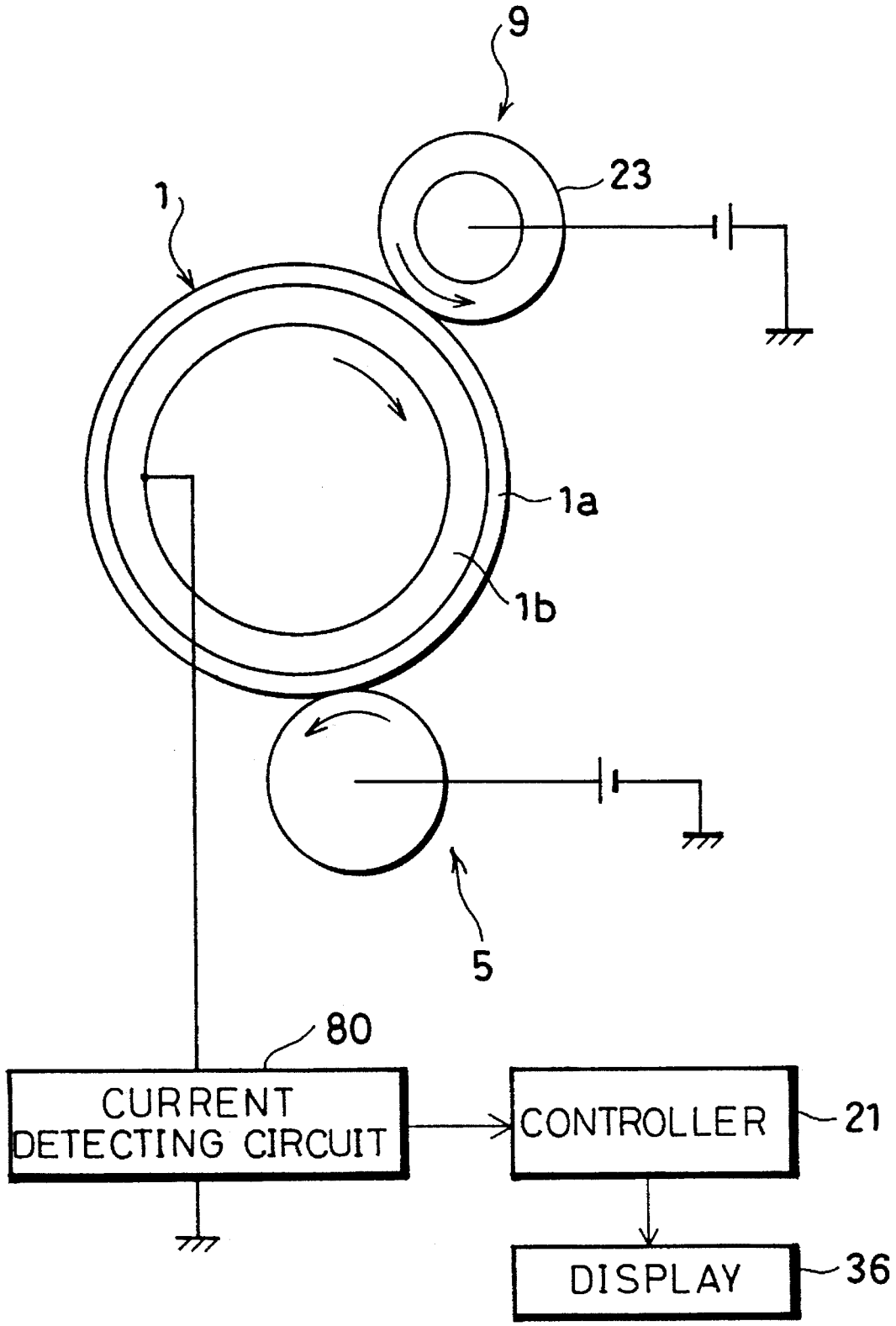
Figure 8:
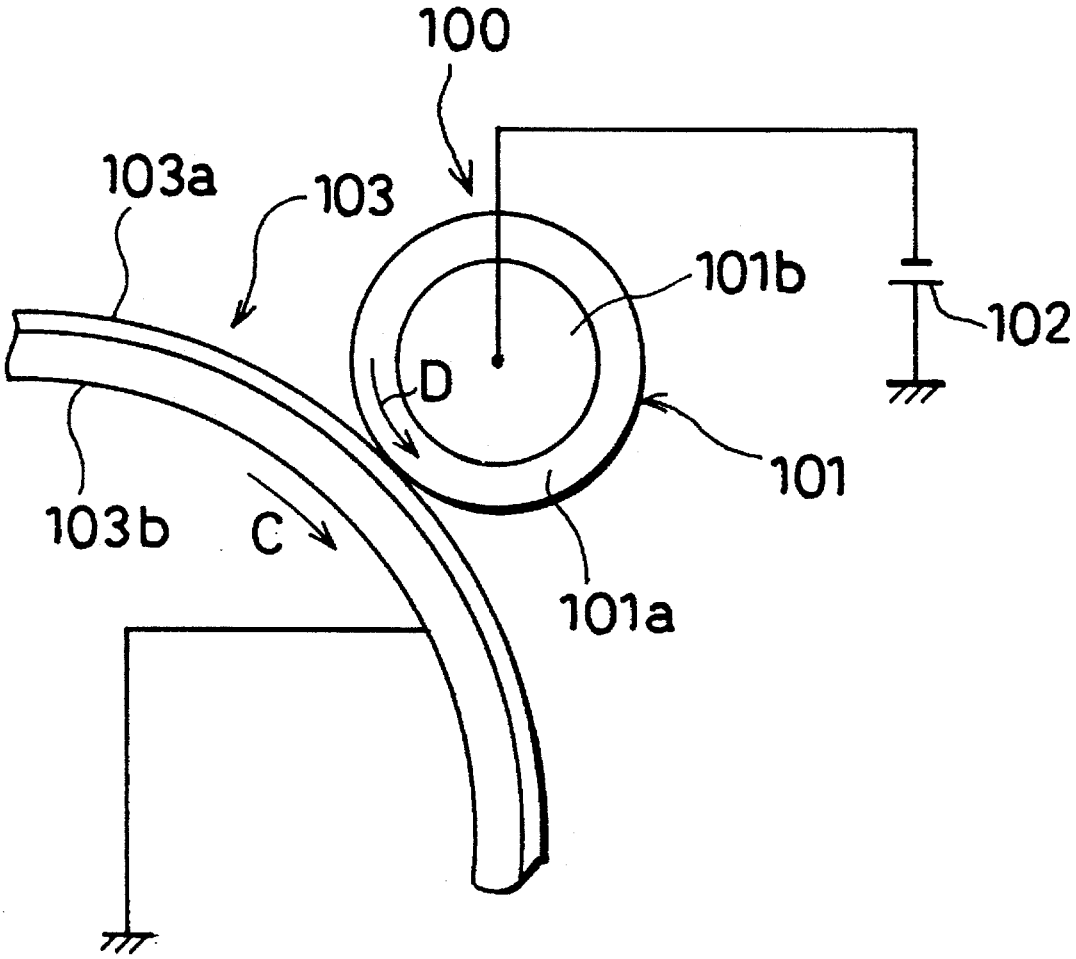
FIG. 8 is a diagram showing essential parts of a contact charger and a photoreceptor.

The following description will discuss the third embodiment of the present invention with reference to FIGS. 7. An electrophotographic printing machine of the present embodiment has the same configuration as the electrophotographic printing machine of the first embodiment except the voltage drop detecting circuit 40. Thus, other members having the same functions as in the first embodiment will be designated by the same codes and their descriptions will be omitted.

In the present embodiment, a current detecting circuit 80 is connected between the drum base 1*b* of the photoreceptor drum 1 and ground as shown in FIG. 7. The current detecting circuit 80 monitors the current flowing across the drum base 1*b* and ground and outputs a detecting signal to the controller 21 when it detects that a current larger than the reference current blows across the drum base 1*b* and ground.

When no defect exists on the photosensitive layer 1*a* of the photoreceptor drum 1, the electrical resistance of the photosensitive layer 1*a* is substantially large. Therefore, when the surface of the photoreceptor drum 1 is being charged by the contact charger, the current flowing across the charge roller 23 and the drum base 1*b* via the photosensitive layer 1*a* is extremely small. In the present embodiment, the surface of the photoreceptor drum 1 is charged to −600 V by the contact charger 9, and a current of substantially 10 μA flows across the drum base 1*b* and ground. In this state, the current detecting circuit 80 does not output a detecting signal.

On the other hand, if a defect exists such as a pin hole on the photosensitive layer 1*a* of the photoreceptor drum 1, a current flowing across the drum base 1*b* and ground increases when the charge roller 23 of the contact charger 9 is in contact with the defective portion of the photoreceptor drum 1. Further, when the current flowing across the drum base 1*b* and ground exceeds the reference current set in the current detecting circuit 80, the current detecting circuit 80 outputs a detecting signal to the controller 21. In the present embodiment, the reference current is set 30 μA.

When the detecting signal is input to the controller 21, the operation of the device is controlled by the controller 21 as described below.

After the power supply for the electrophotographic printing machine is turned ON, if the detecting signal is input to the controller 21 before the device is set in a wait-state ready for forming images, the controller 21 immediately signals to stop the operation of the entire device except the display 36 (see FIG. 5), and it signals the display 36 to display a message indicating to exchange the photoreceptor drum 1.

Furthermore, with the wait state of the device, if the detecting signal is input to the controller 21 in an execution of a sequential image forming process, the controller 21 operates as follows. First, the controller 21 signals to complete the current image forming process. Next, the controller 21 signals to stop the operation of the entire device except the display 36, and it signals the display 36 to display a message indicating to exchange the photoreceptor drum 1.

Alternatively, the controller 21 may be designed such that even in the execution of the sequential image forming process, when the detecting signal is input to the controller 21, the controller 21 immediately signals to stop the operation of the entire device except the display 36, and it signals the display 36 to display a message indicating to exchange the photoreceptor drum 1.

As described, according to the electrophotographic printing machine of the present embodiment, when a defect exists such as a pin hole on the photosensitive layer 1*a* of the photoreceptor drum 1, the operation of the device will be stopped. Therefore, unlike the conventional devices, the image forming process will not be continued with the defective portion on the photosensitive layer 1*a*. This permits to prevent beforehand the contact charger and the transfer unit 5 from breaking down.

In addition, a photo copying machine or a laser printer is preferably used for the electrophotographic printing machine of the present embodiment.

As described, the electrophotographic printing machine in accordance with the present embodiment which is provided with photoreceptor means including a photosensitive layer having a photoconductivity formed on a surface of an electrically conductive base being connected to ground; contact charging means in contact with the photosensitive layer for charging the photosensitive layer by applying thereto a voltage; current detection means for monitoring the current flowing across the base and ground from the contact charging means, and for outputting a detecting signal to control means when the current becomes larger than a reference current; and control means for controlling the operation of the device, wherein the control means signals to stop the operation of the entire device when a detecting signal is input from the current detection means.

According to the above arrangement, when a defect exists such as a pin hole on the photosensitive layer of the photoreceptor means, the operation of the device will be stopped. Therefore, unlike the conventional devices, the image forming process will not be continued with the defective portion on the photosensitive layer. This permits to prevent beforehand the contract charger means from breaking down.

In addition to the above components, the electrophotographic printing machine in accordance with the present embodiment is provided with display means which is controlled by the control means such that when a detecting signal is input from the charge voltage drop detection means, the display means displays a message indicating to exchange the photoreceptor means.

With this arrangement, the operator can recognize that the device has stopped operating due to a faulty photoreceptor drum 1, and the operator can immediately exchange it with a new one.

While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An electrophotographic printing machine comprising:

photoreceptor means including a photosensitive layer having a photoconductivity formed on a surface of an electrically conductive base being connected to ground;

contact charger means in contact with the photosensitive layer for charging the photosensitive layer by applying thereto a voltage;

abnormality detecting signal output means for detecting a defect on the photosensitive layer, such a defect allowing direct electrical conduction to occur between said contact charger means and said electrically conductive base, by detecting excessive current flowing into said photoreceptor means, the excessive current being larger than a current flowing into said photoreceptor means when no defect exists on the photosensitive layer of said photoreceptor means and for outputting an abnormality detecting signal for switching from a first level to a second level; and control means for controlling an operation of said printing machine based on the abnormality detecting signal from said abnormality detecting signal output means.

2. The electrophotographic printing machine as set forth in claim 1, wherein said abnormality detecting signal output means includes:

charge voltage drop detection means for monitoring the voltage being applied to the photosensitive layer from said contact charger means, and for outputting a detecting signal to control means when the voltage has dropped below a reference voltage due to the excessive current flowing into said photoreceptor means, the excessive current being larger than a current flowing into said photoreceptor means when no defect exists on the photosensitive layer of said photoreceptor means.

3. The electrophotographic printing machine as set forth in claim 2, wherein said contact charger means includes an electrically conductive charging member in contact with the photosensitive layer, and charge voltage application means for applying a voltage to the charging member.

4. The electrophotographic printing machine as set forth in claim 3, wherein the charging member is a roller-shaped charge roller.

5. The electrophotographic printing machine as set forth in claim 4, wherein the charge roller includes a cylindrical roller base made of an electrically conductive material, and an electrically conductive elastic layer formed on a surface of the roller base.

6. The electrophotographic printing machine as set forth in claim 5, wherein the electrically conductive elastic layer is made of a silicone rubber including a carbon.

7. The electrophotographic printing machine as set forth in claim 3, wherein the charging member is a brush-shaped charge brush.

8. The electrophotographic printing machine as set forth in claim 3, wherein the charging member is a blade-shaped charge blade.

9. The electrophotographic printing machine as set forth in claim 2, wherein said charge voltage drop detection means includes:

level detection means for comparing the voltage being applied from said contact charger means onto the photosensitive layer with the reference voltage and for outputting a level detecting signal to switching means when the voltage being applied from said contact charger means to the photosensitive layer has dropped below the reference voltage; and switching means for switching a level of a signal to be input to said control means when said switching means receives the level detecting signal from said level detection means.

10. The electrophotographic printing machine as set forth in claim 9, wherein said level detection means is a comparator.

11. The electrophotographic printing machine as set forth in claim 9, wherein said switching means is a photo coupler including a light emitting diode and a photo transistor.

12. The electrophotographic printing machine as set forth in claim 2, further comprising display means being controlled by said control means, wherein said control means signals said display means to display a message indicating to exchange said photoreceptor means based on the detecting signal input from said charge voltage drop detection means.

13. The electrophotographic printing machine as set forth in claim 2, wherein said control means signals to stop the operation of said printing machine directly after said control means receives the detecting signal from said charge voltage drop detection means.

14. The electrophotographic printing machine as set forth in claim 12, wherein said control means signals said display means to display a message indicating to exchange said photoreceptor means directly after said control means receives the detecting signal from said charge voltage drop detection means.

15. The electrophotographic printing machine as set forth in claim 2, wherein when said control means receives a detecting signal from said charge voltage drop detection means while a current image forming process is being executed, said control means signals to stop the operation of said printing machine directly after the current image forming process has been completed.

16. The electrophotographic printing machine as set forth in claim 12, wherein when said control means receives the detecting signal from said charge voltage drop detection means while a current image forming process is being executed, said control means signals said display means to display a message indicating to exchange said photoreceptor means directly after the current image forming process has been completed.

17. The electrophotographic printing machine as set forth in claim 2 is a copying machine.

18. The electrophotographic printing machine as set forth in claim 1 is a laser printer.

19. The electrophotographic printing machine as set forth in claim 1, further comprising:

transfer means in contact with he photosensitive layer for transferring a toner image formed on a surface of said photoreceptor means by applying a voltage to a copying material being sandwiched between said photoreceptor means and said transfer means; and wherein said abnormality detecting signal output means includes:

transfer voltage drop detection means for monitoring voltage being applied to the photosensitive layer from said transfer means and for outputting a detecting signal to control means when the monitored voltage has dropped below a reference voltage due to the excessive current flowing into said photoreceptor means, the excessive current being larger than a current flowing into said photoreceptor means when no defect exists in the photosensitive layer of said photoreceptor means.

20. The electrophotographic printing machine as set forth in claim 19, wherein said transfer means includes an electrically conductive transfer member in contact with the photosensitive layer, and transfer voltage application means for applying a DC voltage to said transfer member, the DC voltage having an opposite polarity to a charge of a toner used in forming the toner image.

21. The electrophotographic printing machine as set forth in claim 20, wherein said transfer member is a roller-shaped transfer roller.

22. The electrophotographic printing machine as set forth in claim 21 wherein the transfer roller in contact with the surface of said photoreceptor means is made of an elastic material.

23. The electrophotographic printing machine as set forth in claim 19, wherein said transfer voltage drop detection means includes:

level detection means for comparing the voltage being applied from said transfer means onto the photosensitive layer with the reference voltage, and for outputting a level detecting signal to switching means when the voltage being applied from said transfer means to the photosensitive layer has dropped below the reference voltage; and switching means for switching a level of a signal to be input to said control means when said switching means receives the level detecting signal from said level detection means.

24. The electrophotographic printing machine as set forth in claim 23, wherein said level detection means is a comparator.

25. The electrophotographic printing machine as set forth in claim 23, wherein said switching means is a photo coupler including a light emitting diode and a photo transistor.

26. The electrophotographic printing machine as set forth in claim 19, further comprising display means being controlled by said control means, wherein said control means signals said display means to display a message indicating to exchange said photoreceptor means based on the detecting signal input from said transfer voltage drop detection means.

27. The electrophotographic printing machine as set forth in claim 19, wherein said control means stops the operation of said printing machine directly after said control means receives the detecting signal from said transfer voltage drop detection means.

28. The electrophotographic printing machine as set forth in claim 26, wherein said control means signals said display means for displaying a message to exchange said photoreceptor means directly after said control means receives the detecting signal from said transfer voltage drop detection means.

29. The electrophotographic printing machine as set forth in claim 19, wherein when said control means receives the detecting signal from said transfer voltage drop detection means while a current image forming process is being executed, said control means signals to stop the operation of said printing machine directly after the current image forming process has been completed.

30. The electrophotographic printing machine as set forth in claim 26, wherein when said control means receives the detecting signal from said transfer voltage drop detection means while a current image forming process is being executed, said control means signals said display means to display a message indicating to exchange said photoreceptor means directly after the current image forming process has been completed.

31. The electrophotographic printing machine as set forth in claim 19 is a copying machine.

32. The electrophotographic printing machine as set forth in claim 19 is a laser printer.

33. The electrophotographic printing machine as set forth in claim 1, wherein said abnormality detecting signal output means includes:

current detection means for monitoring a current flowing across the base and ground and for outputting a detecting signal to control means when the current becomes larger than a reference current due to the excessive current flowing into said photoreceptor means, the excessive current being larger than a current flowing into said photoreceptor means when no defect exists on the photosensitive layer of said photoreceptor means.

34. The electrophotographic printing machine as set forth in claim 33 further comprising display means being controlled by said control means, wherein said control means signals said display means to display a message indicating to exchange said photoreceptor means based on a detecting signal input from said current detection means.

35. The electrophotographic printing machine as set forth in claim 33 wherein said control means signals to stop the operation of said printing machine directly after said control means receives the detecting signal from said current detection means.

36. The electrophotographic printing machine as set forth in claim 34, wherein said control means signals said display means to display a message indicating to exchange said photoreceptor means directly after said control means receives the detecting signal from said current detection means.

37. The electrophotographic printing machine as set forth in claim 33, wherein when said control means receives the detecting signal from said current detection means while a current image forming process is being executed, said control means signals to stop the operation of said printing machine directly after the current image forming process has been completed.

38. The electrophotographic printing machine as set forth in claim 34, wherein when said control means receives the detecting signal from said current detection means while a current image forming process is being executed, said control means signals said display means to display a message indicating to exchange said photoreceptor means directly after the current image forming process has been completed.

39. The electrophotographic printing machine as set forth in claim 33 is a copying machine.

40. The electrophotographic printing machine as set forth in claim 33 is a laser printer.

41. The machine of claim 1 wherein said abnormality detecting signal is a single-bit signal capable of assuming only two discrete binary levels.

42. The machine of claim 1 wherein said abnormality detecting signal indicates a detection of a defect existing in the photoreceptor means as a result of using said contact charger means, such a defect allowing excessive current to flow through said photosensitive layer and adversely affecting said contact charger means.

* * * * *